US010463155B2

(12) United States Patent
Hector et al.

(10) Patent No.: US 10,463,155 B2
(45) Date of Patent: Nov. 5, 2019

(54) FASTENERLESS ARM PAD ATTACHMENT MECHANISM

(71) Applicant: Knoll, Inc., East Greenville, PA (US)

(72) Inventors: Andrew Blair Hector, East Greenville, PA (US); Christopher Flynn, East Greenville, PA (US)

(73) Assignee: Knoll, Inc., East Greenville, PA (US)

( * ) Notice: Subject to any disclaimer, the term of this patent is extended or adjusted under 35 U.S.C. 154(b) by 0 days.

(21) Appl. No.: 16/243,333

(22) Filed: Jan. 9, 2019

(65) Prior Publication Data

US 2019/0223604 A1 Jul. 25, 2019

Related U.S. Application Data

(60) Provisional application No. 62/620,177, filed on Jan. 22, 2018.

(51) Int. Cl.
*A47C 7/54* (2006.01)
*B68G 5/00* (2006.01)

(52) U.S. Cl.
CPC . *A47C 7/54* (2013.01); *B68G 5/00* (2013.01)

(58) Field of Classification Search
CPC ..... A47C 7/54; A47C 7/546; B68G 5/00
USPC ..... 297/411.46, 411.2
See application file for complete search history.

(56) References Cited

U.S. PATENT DOCUMENTS

| | | | |
|---|---|---|---|
| 4,380,352 | A | 4/1983 | Diffrient |
| 4,951,995 | A | 8/1990 | Teppo et al. |
| 5,056,863 | A | 10/1991 | DeKraker et al. |
| 5,265,938 | A | 11/1993 | Mehuish et al. |
| 5,382,079 | A | 1/1995 | Wilson et al. |
| 5,393,125 | A | 2/1995 | Watson et al. |
| 5,415,459 | A | 5/1995 | Schultz |
| 5,439,267 | A | 8/1995 | Peterson et al. |
| 5,484,187 | A | 1/1996 | Doerner et al. |
| 5,599,067 | A | 2/1997 | Schuelke et al. |
| 5,641,203 | A | 6/1997 | Van De Riet et al. |
| 5,664,842 | A | 9/1997 | Tseng |

(Continued)

FOREIGN PATENT DOCUMENTS

| | | | |
|---|---|---|---|
| CN | 204519955 | U | 8/2015 |
| EP | 1410741 | A1 | 4/2004 |
| JP | 2011130978 | A | 7/2011 |

OTHER PUBLICATIONS

International Search Report for PCT/US2019/013007 dated Apr. 23, 2019.

(Continued)

*Primary Examiner* — Mark R Wendell
(74) *Attorney, Agent, or Firm* — Buchanan Ingersoll & Rooney PC

(57) ABSTRACT

A chair can include armrest apparatuses. Each of the armrest apparatuses can be configured so an arm pad is connectable to an armrest without the use of a mechanical fastener (e.g. a screw, a bolt, etc.) and without the use of an adhesive or welding, and without the use of mechanical tools (e.g. screw driver, hammer, etc.) by use of interlocking mating profiles defined in the structure of the arm pad and structure of the armrest to which the arm pad is attached. Embodiments of the chair can be configured as a side chair, task chair, or other type of chair having at least one armrest or other type of armrest apparatus.

17 Claims, 5 Drawing Sheets

(56) References Cited

U.S. PATENT DOCUMENTS

| | | | |
|---|---|---|---|
| 5,667,277 | A | 9/1997 | Van De Riet |
| 5,676,483 | A | 10/1997 | Koubek |
| 5,746,479 | A | 5/1998 | Bodnar |
| 5,765,920 | A | 6/1998 | Lai |
| 6,053,577 | A | 4/2000 | Arko et al. |
| 6,076,892 | A | 6/2000 | van Hekken et al. |
| 6,176,550 | B1 | 1/2001 | Lamart et al. |
| 6,394,553 | B1 | 5/2002 | McAllister et al. |
| 6,419,323 | B1 | 7/2002 | Chu et al. |
| 6,540,300 | B2 | 4/2003 | Piretti |
| 6,672,670 | B2 | 1/2004 | Funk et al. |
| 6,802,566 | B2 | 10/2004 | Prince et al. |
| 6,840,582 | B2 | 1/2005 | Burwell et al. |
| 6,877,813 | B2 | 4/2005 | Caruso et al. |
| 6,974,189 | B2 | 12/2005 | Machael et al. |
| 7,066,546 | B2 | 6/2006 | Trego et al. |
| 7,100,977 | B2 | 9/2006 | Burwell et al. |
| 7,234,779 | B2 | 6/2007 | Bedford et al. |
| 7,533,939 | B2 | 5/2009 | Fookes et al. |
| 7,644,991 | B2 | 1/2010 | Davis et al. |
| 7,828,389 | B2 | 11/2010 | Oda |
| 7,841,665 | B2 | 11/2010 | Geister et al. |
| 8,016,360 | B2 | 9/2011 | Machael et al. |
| 8,029,060 | B2 | 10/2011 | Parker et al. |
| 8,246,117 | B2 | 8/2012 | Mehuish et al. |
| 8,480,171 | B2 | 7/2013 | Chadwick et al. |
| 8,616,640 | B2 | 12/2013 | van Hekken |
| 9,351,575 | B2 | 5/2016 | Hector et al. |
| 9,700,139 | B2 * | 7/2017 | Su ..... A47C 1/03 |
| 9,861,205 | B2 | 1/2018 | Hector et al. |
| 2015/0164233 | A1 * | 6/2015 | Hsieh ..... A47C 7/54 297/411.46 |

OTHER PUBLICATIONS

Written Opinion of the International Search Authority for PCT/US2019/013007 dated Apr. 23, 2019.

* cited by examiner

FASTENERLESS ARM PAD ATTACHMENT MECHANISM

CROSS-REFERENCE TO RELATED APPLICATIONS

The present application claims priority to U.S. Provisional Patent Application No. 62/620,177, which was filed on Jan. 22, 2018. The entirety of U.S. Provisional Patent Application No. 62/620,177 is incorporated by reference herein.

FIELD OF INVENTION

The present invention relates to chairs, armrests for chairs, and methods of making and using armrests for chairs.

BACKGROUND OF THE INVENTION

Chairs often include armrests. The armrests can include an arm pad. Often the arm pad is attached to supporting armrest structure by one or more fastening mechanisms (e.g. bolts, screws, adhesives, etc.). Examples of armrests that can be included in chairs can be appreciated from U.S. Pat. Nos. 9,861,205, 9,351,575, 8,616,640, 8,480,171, 8,246,117, 8,029,060, 8,016,360, 7,841,665, 7,828,389, 7,644,991, 7,533,939, 7,234,779, 7,100,977, 7,066,546, 6,974,189, 6,877,813, 6,840,582, 6,802,566, 6,672,670, 6,540,300, 6,419,323, 6,394,553, 6,176,550, 6,076,892, 6,053,577, 5,765,920, 5,746,479, 5,676,483, 5,667,277, 5,664,842, 5,641,203, 5,599,067, 5,484,187, 5,439,267, 5,415,459, 5,393,125, 5,382,079, 5,265,938, 5,056,863, 4,951,995, and 4,380,352.

SUMMARY OF THE INVENTION

An armrest is provided for a chair that can permit an arm pad to be connected to an armrest support without the use of any type of external fastener (e.g. adhesive, screw, bolt etc.). Instead, interlocking profiles of the arm pad an armrest structure to which the arm pad is to be attached can be provided for facilitating an attaching interlock between the arm pad and the armrest structure without the use of an external fastener or adhesive or of welding. Embodiments can be configured so that corresponding sets of projections or protuberances defined in one of the arm pad and arm pad support/armrest support structure(s) interlockingly mate with structure defining corresponding apertures (e.g. recesses, openings, holes, etc.) in the other of the am pad and arm pad support/armrest support structure(s). Methods of utilizing embodiments of the armrest support apparatus are also provided herein.

Some embodiments of an armrest apparatus for a chair can include an arm pad having a bottom and a wall projecting from a surface of the bottom to define an inner aperture. The wall can define spaced apart recesses that each have an opening mouth that face into the inner aperture and are in communication with the inner aperture. The armrest apparatus can also include an arm pad support plate that is configured for attachment to an armrest support member. The armrest support member can be configured to attach the arm pad support plate to a backrest, seat, and/or base of a chair. The arm pad support plate can have a wall that at least partially defines an inner cavity. The wall can have a plurality of projections extending horizontally away from the wall. The projections can be resilient. Each of the projections can be sized and shaped to be matingly and interlockingly received within a respective one of the recesses of the wall of the arm pad for fastenerless connection of the arm pad to the arm pad support plate.

In some embodiments, each of the projections extending horizontally away from the wall of the arm pad support plate can be configured to resiliently deform for insertion into the opening mouth of the recess of the wall of the arm pad to which the projection is inserted so that resiliency of the projection causes the projection to help provide an interference fit connection between the projection and the wall of the arm pad having the recess in which the projection is inserted. The horizontally extending projections can have a pre-selected shape. For example, they can be shaped to have a generally rectangular shape, pentagonal shape, hexagonal shape, a polygonal shape, half-circle type shape, arcuate shape, curved shape, or irregular shape that is mateable within a respective recess of the wall and insertable within the shaped opening mouth of that recess.

In some embodiments, the arm pad support plate can have a plurality of columns. Each of the columns can be positioned in the inner cavity. A top of each of the columns can be positioned above a top of the wall of the arm pad support plate (e.g. each column can be taller than the height of the wall or each column can extend further away from the arm pad support plate than the wall of the arm pad support plate.

In some embodiments, the arm pad can also have a plurality of projections extending from the bottom of the arm pad (e.g. a bottom surface of the bottom of the arm pad). Each of the projections can be configured to extend into a hole of a respective column. Each of the projections that extend from the bottom of the arm pad can be configured to resiliently deform for insertion into the hole of the column to which the projection is insertable so that resiliency of the projection causes the projection to help provide an interference fit connection between the projection and the column having the hole in which the projection is inserted. The projections extending from the bottom of the arm pad can each have a pre-selected shape. For example, they can each be shaped to have a generally rectangular shape, pentagonal shape, hexagonal shape, a polygonal shape, half-circle type shape, arcuate shape, curved shape, or irregular shape that is mateable within a respective hole of the column and insertable within the shaped opening mouth of the hole of the column in which the projection is insertable.

Embodiments of an armrest apparatus for a chair can include an arm pad having a bottom, a wall projecting from a surface of the bottom to define an inner aperture, and a plurality of locking members extending from the surface of the bottom positioned at least partially in the inner aperture. The armrest support apparatus can also include an arm pad support plate that can be configured for attachment to an armrest support member. The arm pad support plate can have a plurality of locking feature apertures. Each locking feature aperture can be configured to receive a respective one of the locking members to directly attach the arm pad to the arm pad support plate for fastenerless connection of the arm pad to the arm pad support plate.

The plurality of locking feature apertures can include apertures that are structured to define ramped surfaces of the arm pad support plate. The ramped surfaces can be linearly sloped. Rear ends of the ramped surfaces can be positioned deeper into the arm pad support plate than front ends of the ramped surfaces The plurality of locking feature apertures can also include (or alternatively include) a front edge locking feature aperture that defines a front profile of the arm pad support plate that is sized and configured to receive the front locking member that extends from the bottom of the arm pad. The front profile can define a lower front surface below the top surface of the arm pad support plate and a gap defined between the lower front surface of the arm pad support plate and the top surface of the arm pad support plate. The rear edge portion of a front locking member can be received with the gap defined between the lower front surface of the arm pad support plate and the top surface of the arm pad support plate.

The plurality of locking feature apertures can also (or alternatively) include a recess within the top surface of the arm pad support plate.

The plurality of locking members can include a plurality of ramp contacting members. Each of the ramp contacting members can be configured to contact a respective one of the ramped surfaces of the arm pad support plate to engage the ramped surface within the locking feature aperture that is structured to define the ramped surface that is engaged by the ramp contacting member.

The plurality of locking members can also (or alternatively) include a front locking member that extends from the bottom of the arm pad that is positioned at least partially within the inner aperture of the arm pad. The front locking member can extend from the bottom of the arm pad such that a rear edge portion of the front locking member is spaced part from the bottom of the arm pad by a gap.

The plurality of locking members can also (or alternatively) include a resilient locking finger that extends from the bottom of the arm pad. The resilient locking finger can have a distal edge that is configured to be received within thee recess and resiliently engage at least one sidewall that defines the recess. The front edge of the resilient finger may be integral to a bottom of the arm pad or otherwise positioned thereon.

A method of attaching an arm pad to an arm pad support plate for fastenerless connection of the arm pad to the arm pad support plate is also provided. The method can include providing an embodiment of an arm pad support plate and providing an embodiment of an arm pad. The arm pad can be manipulated to directly attach the arm pad to the arm pad support plate without the use of a mechanical tool, fastener, adhesive, and/or welding. This can include, for example, sliding the arm pad along the arm pad support plate without the use of a mechanical tool, fastener, adhesive, and welding to have projections interlock to structure defining apertures. The arm pad may only have the projections or may only have the apertures. The arm pad can also have some projections and some apertures and the arm pad support plate can have some apertures for receiving projections of the arm pad and some projections for insertion into apertures of the arm pad.

Some embodiments of a method of attaching an arm pad to an arm pad support plate for fastenerless connection of the arm pad to the arm pad support plate can include providing an arm pad support plate. The arm pad support plate can have: (a) a wall that at least partially defines an inner cavity, the wall having a plurality of projections extending horizontally away from the wall, the projections being resilient, and/or (b) a plurality of locking feature apertures for fastenerless connection of the arm pad to the arm pad support plate. The method can also include providing an arm pad arm pad having a bottom and a wall projecting from a surface of the bottom to define an inner aperture. The wall of the arm pad can define spaced apart recesses that each have an opening mouth that face into the inner aperture and are in communication with the inner aperture where each of the recesses is sized and configured to receive a respective one of the projections of the wall of the arm pad support plate. Also, or alternatively, a plurality of locking members can extend from the surface of the bottom of the arm pad and be positioned at least partially in the inner aperture. The method can also include positioning the arm pad along the arm pad support member for directly attaching the arm pad to the arm pad support plate for fastenerless connection of the arm pad to the arm pad support plate. In some embodiments, such positioning can occur via sliding the arm pad along the arm pad support plate and/or by pressing the arm pad onto the arm pad support plate.

For example, some embodiments of the method can include providing an arm pad support plate where the arm pad support plate has a wall that at least partially defines an inner cavity. The wall can have a plurality of resilient projections extending horizontally away from the wall and the arm pad support plate can have a plurality of locking feature apertures for fastenerless connection of the arm pad to the arm pad support plate. An am pad can be provided that has a bottom, a wall projecting from a surface of the bottom to define an inner aperture. The wall of the arm pad can define spaced apart recesses that each have an opening mouth that face into the inner aperture and are in communication with the inner aperture where each of the recesses is sized and configured to receive a respective one of the projections of the wall of the arm pad support plate and the arm pad can include a plurality of locking members extending from the surface of the bottom of the arm pad positioned at least partially in the inner aperture. The method can also include positioning the arm pad along the arm pad support member for directly attaching the arm pad to the arm pad support plate for fastenerless connection of the arm pad to the arm pad support plate. This positioning can include a sliding motion or other type of positioning (e.g. placing the arm pad to cover the arm pad support plate and pressing the arm pad down onto the arm pad support plate, etc.).

Other details, objects, and advantages of the invention will become apparent as the following description of certain present preferred embodiments thereof and certain present preferred methods of practicing the same proceeds.

BRIEF DESCRIPTION OF THE DRAWINGS

Exemplary embodiments of the chair and armrest apparatus for a chair are shown in the accompanying drawings. It should be appreciated that like reference numbers used in the drawings may identify like components.

DETAILED DESCRIPTION OF EXEMPLARY EMBODIMENTS

Figure 1:
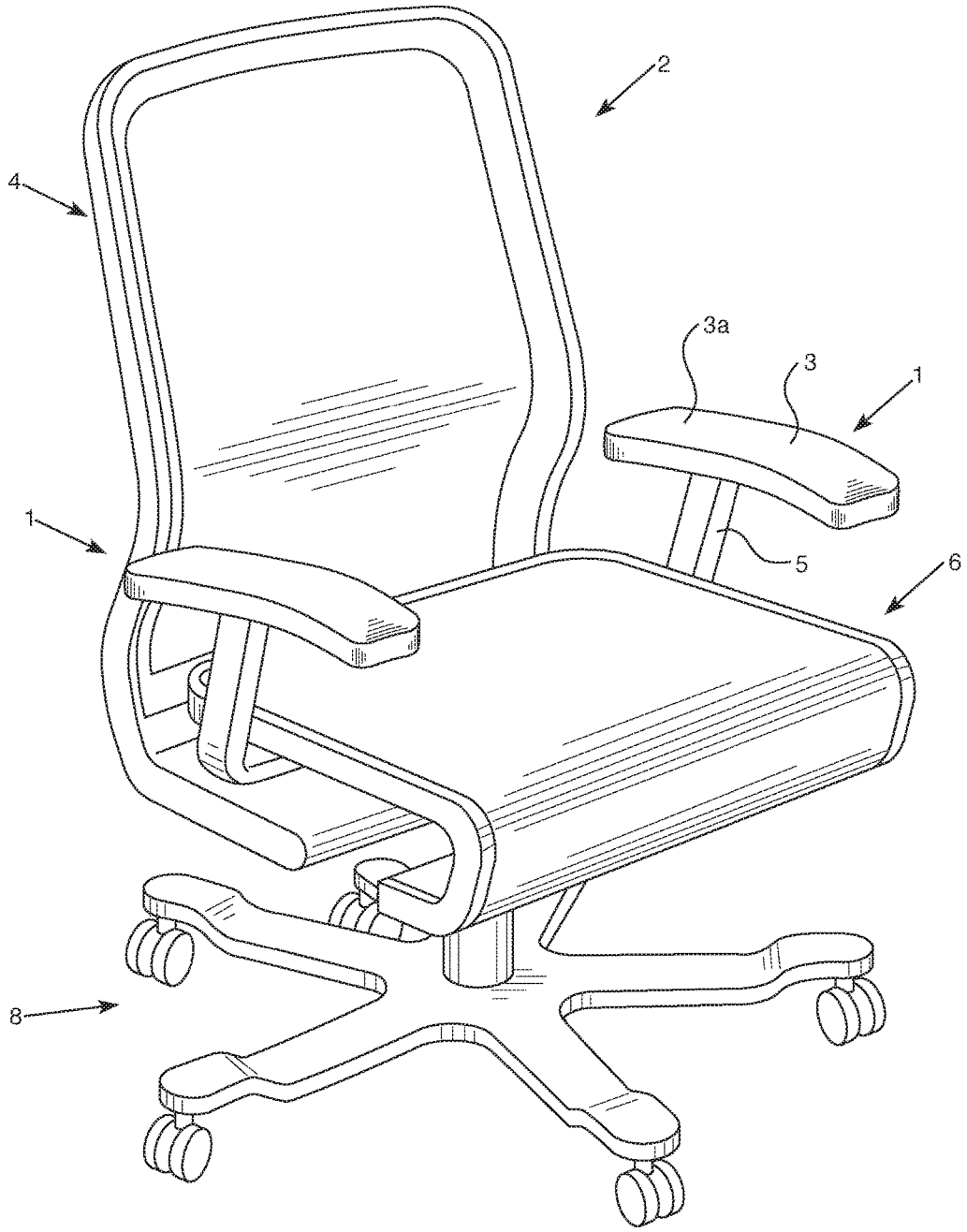
FIG. 1 is a perspective view of a first exemplary embodiment of a chair that includes a first exemplary embodiment of an armrest apparatus 1 for a chair that includes an arm pad 3 attached to an armrest support member 5 that is configured for attachment to the seat and/or base of a chair.
Figure 2:
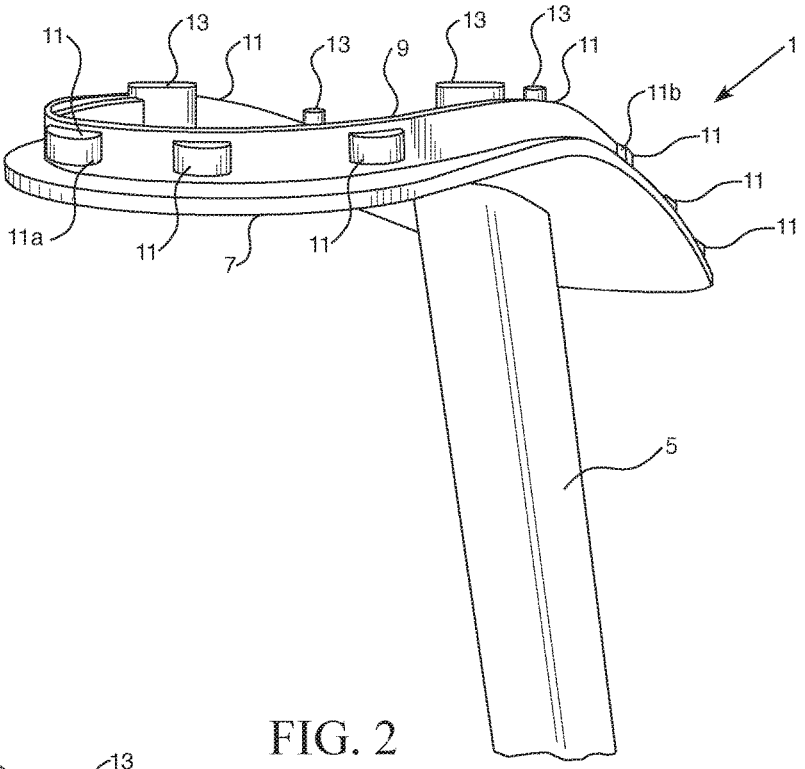
FIG. 2 is a perspective view of the first exemplary embodiment of the armrest apparatus 1 with the arm pad removed.
Figure 3:
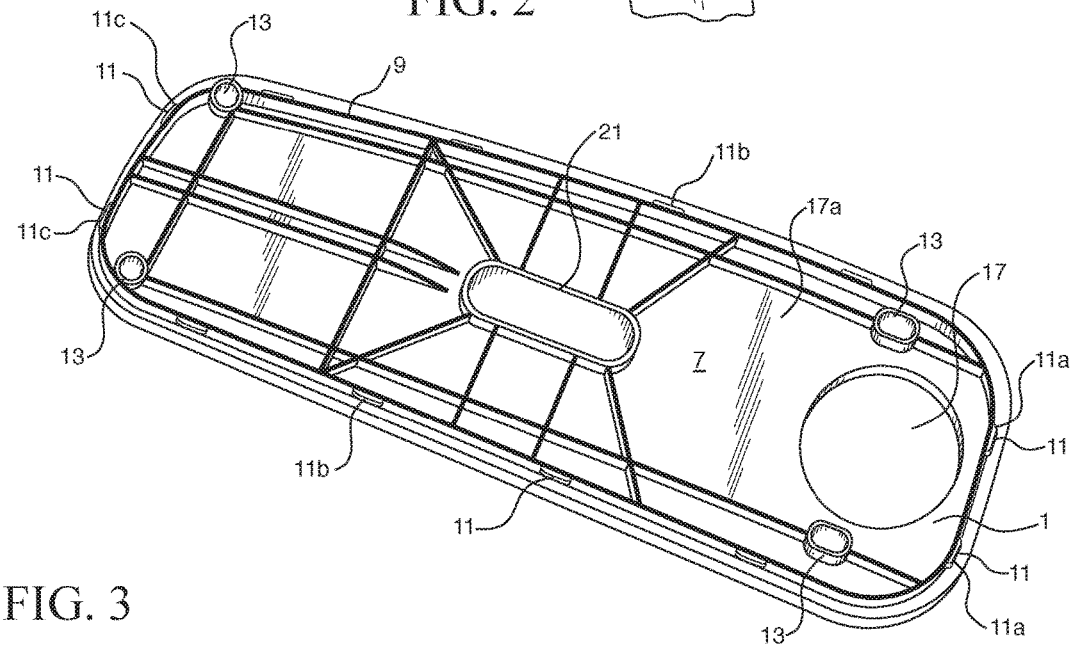
FIG. 3 is a top view of the first exemplary embodiment of the armrest apparatus 1 with the arm pad removed.
Figure 4:
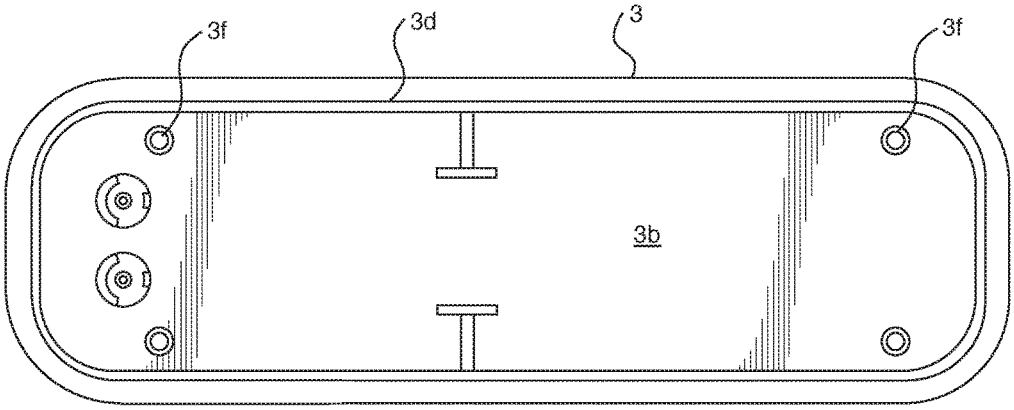
FIG. 4 is a bottom view of the arm pad 3 of the first exemplary embodiment of the armrest apparatus 1.
Figure 5:
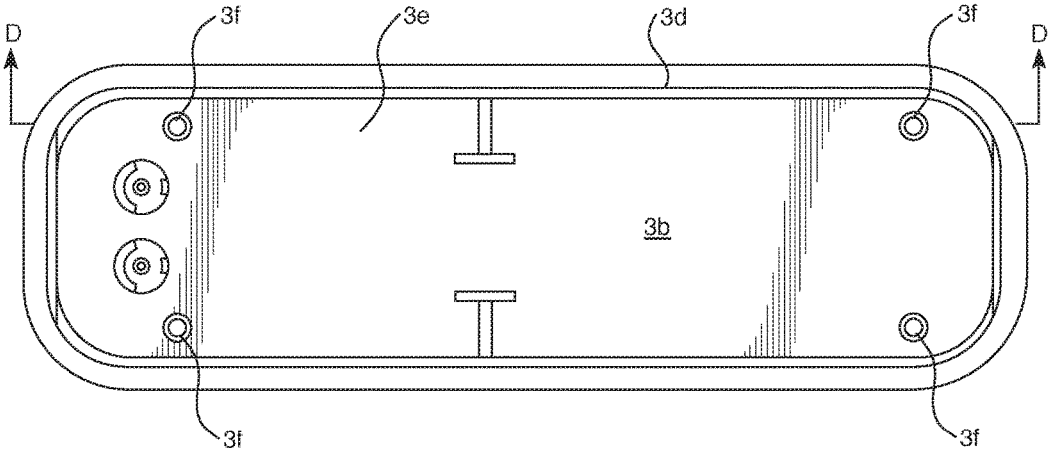
FIG. 5 is a bottom view similar to FIG. 4 of the arm pad 3.
Figure 6:
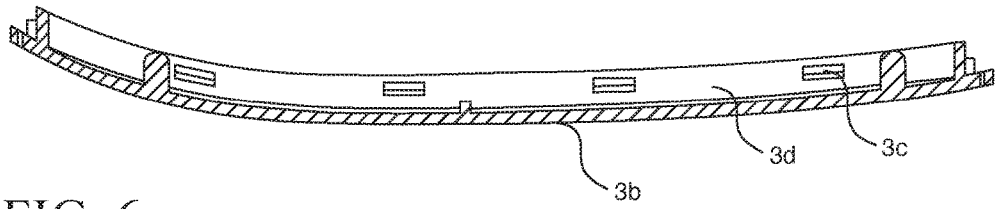
FIG. 6 is a cross sectional view of the arm pad 3 taken along line D-D illustrated in FIG. 5.

Referring to FIGS. 1-8, a chair 2 can include a base 8 that supports a backrest 4, a seat 6, and multiple armrest apparatuses 1. The base 8 can be structured as a pedestal base, have a plurality of legs, or have another type of structure for supporting the seat. The backrest 4 can be connected to the seat 6 and/or the base 8. The seat 6 can be supported by the base 8. In some embodiments, a tilt mechanism can be attached to the base 8, the backrest 4 and/or the seat 6 to facilitate tilting of the backrest 4 and/or synchronous motion of the seat and backrest 4 when the backrest 4 is reclined.

Each armrest apparatus 1 can be attached to the frame of the backrest 4, the frame of the seat 6 and/or the base 8 of the chair. Typically, each armrest apparatus is configured to position an arm pad 3 above the seat 6 and forward of the backrest 4 and positions the arm pad 3 so that it is adjacent a side of the seat (e.g. a left side or a right side of the chair 2 that is between the front side of the chair and the rear side of the chair).

The armrest apparatus 1 can include an arm pad 3 having a bottom 3*b* and a top 3*a*. The bottom 3*b* can have a single wall 3*d* that extends along the bottom of the arm pad adjacent an edge of the bottom of the arm pad. The wall 3*d* can project vertically from a surface of the bottom to define an inner aperture 3*e*. In some embodiments, the single wall 3*d* can be a plurality of interconnected wall segments that define a particular shaped aperture 3*e* (e.g. polygonal or irregular shaped as compared to a circular shape, oval shape, or other type of shape defined by a single continuous wall).

The wall 3*d* can define spaced a part recesses 3*c* (e.g. slots having a mouth that opens into the inner aperture 3*e* so that the mouth is in communication with the inner aperture 3*e*). The recesses 3*c* can be configured so that the outermost part of the wall encloses the recess so that each recess defines a cavity having only a single mouth opening that is in communication with the inner aperture 3*e* by which a projection or protuberance could enter or exit the recess 3*c*. The wall 3*d* can define each recess to have a pre-selected shape (e.g. rectangular slot type shape, polygonal shaped recess, semi-circular type shaped recess or hole, etc.).

The arm pad 3 can be configured so that a pad is attached to an arm pad support plate that defines the bottom of the arm pad 3. The arm pad support plate 7 can be formed from a polymeric material and/or an elastomeric material so that the arm pad support plate is formed as a unitary structure to have the wall 3*d* and the recess 3*c* within the wall 3*d*.

The arm pad support plate 7 can be configured for attachment to an armrest support member 5 and to the arm pad 3 so that the arm pad support plate 7 is between the arm pad 3 and the armrest support member 5. The armrest support member 5 can be a leg, post, or other member that can be sized and configured to attach the arm pad 3 to the base, seat, and/or backrest of a chair via the direct attachment of the armrest support member 5 to the arm pad support plate 7. For instance, the arm pad support plate 7 can be directly attached to the armrest support member 5 and the arm pad 3 to facilitate connection of the armrest support member 5 to support the arm pad 3 in at least one desired position above a seat adjacent a left side of the chair or right side of the chair.

The arm pad support plate 7 can have a wall 9 that extends vertically upwards from an upper surface of the arm pad support plate 7. The wall 9 can be structured to at least partially define an inner cavity 17 or entirely define an inner cavity 17. The inner cavity 17 can be structured as an opening that is defined between an upper surface of the arm pad support plate 7 and the wall 9. In some embodiments, the wall 9 can be shaped as an annular type structure having a circular or oval type shape for defining the inner cavity 17. In other embodiments, the wall can include multiple linearly extending segments that define a polygonal annular shape for defining the inner cavity 17. The wall 9 of the arm pad support plate 7 can have a plurality of projections 11 extending horizontally therefrom. The horizontally extending projections 11 can have a pre-selected shape. For example, each projection 11 can be shaped to have a generally rectangular shape, pentagonal shape, hexagonal shape, a polygonal shape, half-circle type shape, arcuate shape, curved shape, irregular shape, or other shape that is mateable within a respective recess 3*c* of the wall and insertable within the shaped opening mouth of that recess for matingly interlocking within the recess 3*c*.

Each of the projections 11 extending from the wall 9 of the arm pad support plate 7 can be flexible and/or resilient. Each of the projections 11 can be sized and shaped to be matingly and interlockingly received within a respective one of the recesses 3*c* of the wall 3*d* of the arm pad 3 so that the arm pad 3 can be matingly interlocked and attached to the arm pad support plate 7 without the use of any mechanical fastener (e.g. bolt, screw, etc.) and without the use of an adhesive or welding. The structure of the arm pad 3 and arm pad support plate 7 can facilitate a user manipulating the arm pad to press the arm pad 3 onto the arm pad support plate 7 via a pushing motion and/or other motion (e.g. sliding and pressing, just pressing the arm pad 3 over the arm pad support plate, etc.).

The projections 11 can include projections that are spaced apart along the entire periphery of the wall 9 adjacent a top of the arm pad support plate 7. The projections 11 can include, for example, front projections 11*a*, side projections 11*b* on left and right sides, and rear projections 11*c*. Each of the projections can extend horizontally from the wall 9 away from the wall 9 and away from the inner cavity 17 (e.g. each projection 11 can have a distal edge that is farther from the wall 9 and cavity 17 than its proximal edge. The proximal edge of each projection can be integral to the wall 9 or at the wall/proximal edge interface). The spaced apart projections 11 can be composed of a polymeric material that is defined in the wall structure of wall 9 of a polymeric arm pad support plate 7 so that the projections 11, wall 9, and arm pad support plate 7 are an integral, unitary structure formed from a single molding operation (e.g. injection molding, etc.). The projections 11 can be composed of a suitable material and be sized and shaped so that the projections 11 are resilient so that the projections 11 can be resiliently deformed when positioned into the recesses 3*c* so that the resiliency of the projections 11 help provide a tight interference fit within the recesses 3*c* for an interlocked engagement within the recesses 3*c* to help provide a fastenerless interconnection between the arm pad 3 and the arm pad support plate 7 by resiliently acting in response to the deformation for insertion into the recesses 3*c* to resiliently return to their original shape while being positioned in the recess 3*c*.

The arm pad support plate 7 can also include a number of vertically projecting columns 13 positioned within the inner cavity 17. The columns 13 can extend vertically from a top surface or upper surface of the arm pad support plate that helps define a bottom 17*a* of the cavity 17. The columns 13 can extend vertically so that a top of each column 13 is positioned higher than a top of the wall 9. Each of the columns 13 can have one or more upper holes to receive vertically extending projections 3*f* that extend from the bottom 3*b* of the arm pad 3. The projections 3*f* can matingly inter-fit within the holes defined in the columns 13 to help guide attachment of the arm pad to the arm pad support plate 7. In some embodiments, the columns 13 and projections 3*f* can be structured to function as more than just guides to help facilitate attachment of the arm pad 3 to the arm pad support plate 7. For such embodiments, the holes defined in the columns 13 and the size, shape, and material composition of the projections 3*f* can be configured to provide a further interference fit type connection between the arm pad 3 and the arm pad support plate 7 to help provide for the fastenerless interconnection between these components by the projections 3*f* being configured to resiliently deform for insertion into the holes of the columns 13 so that the resiliency of the projections 3*f* cause the projections to try and return to their original size and shape when in the holes of the columns 13 to help provide a tighter interference fit connection between projections 3*f* and columns 13.

It should be appreciated that each of the projections 3*f* that extend from the bottom of the arm pad 3 can be configured to resiliently deform for insertion into the hole of the column to which the projection 3*f* is to be inserted so that resiliency of the projection 3*f* causes the projection to help provide an interference fit connection between the projection 3*f* and the column 13 having the hole in which the projection 3*f* is inserted. The projections 3*f* extending from the bottom of the arm pad 3 can each have a pre-selected shape. For example, they can each be shaped to have a generally rectangular shape, pentagonal shape, hexagonal shape, a polygonal shape, half-circle type shape, arcuate shape, curved shape, or irregular shape that is mateable within a respective hole of the column 13 and insertable within the shaped opening mouth of the hole of the column 13 in which the projection 3*f* is to be inserted.

An upper surface of the arm pad support plate 7 that defines the bottom 17*a* of the cavity 17 can be shaped and structured to define a bottom opening 21 within the inner cavity 17. The opening 21 can be sized and configured to receive an upper portion of the armrest support member 5 to facilitate a direct attachment of the upper end of the armrest support member 5 to the arm pad support plate 7. A profile of the upper portion of the armrest support member 5 can be sized and shaped to mate with the profile of the defined opening 21 to provide for such a direct connection. In some embodiments, the interlocking profile can be structured so that the arm pad support plate 7 is directly attached to the armrest support member 5 without the use of fasteners or other type of fastening mechanism (e.g. adhesive, welding, bolts, screws, rivets, etc.).

The upper surface of the arm pad support plate 7 that defines the bottom 17*a* of the cavity 17 can be shaped and structured to define other openings to facilitate attachment to one or more actuators. For example, an opening can be defined in the bottom 17*a* of the cavity to facilitate a connection with an armrest height adjustment actuator or an arm pad movement lock actuator.

In some embodiments, the arm pad 3 can include an arm pad movement mechanism that can permit the top 3*a* of the arm pad to be slid or rotated relative to the bottom 3*b* of the arm pad and relative to the arm pad support plate 7. For example, the arm pad 3 can include an internal series of plates or other structure that are slotted or otherwise configured to connect the top 3*a* of the arm pad 3 to the bottom 3*b* of the arm pad 3 to facilitate motion of the top of the arm pad relative to the bottom of the arm pad 3.

Figure 7:
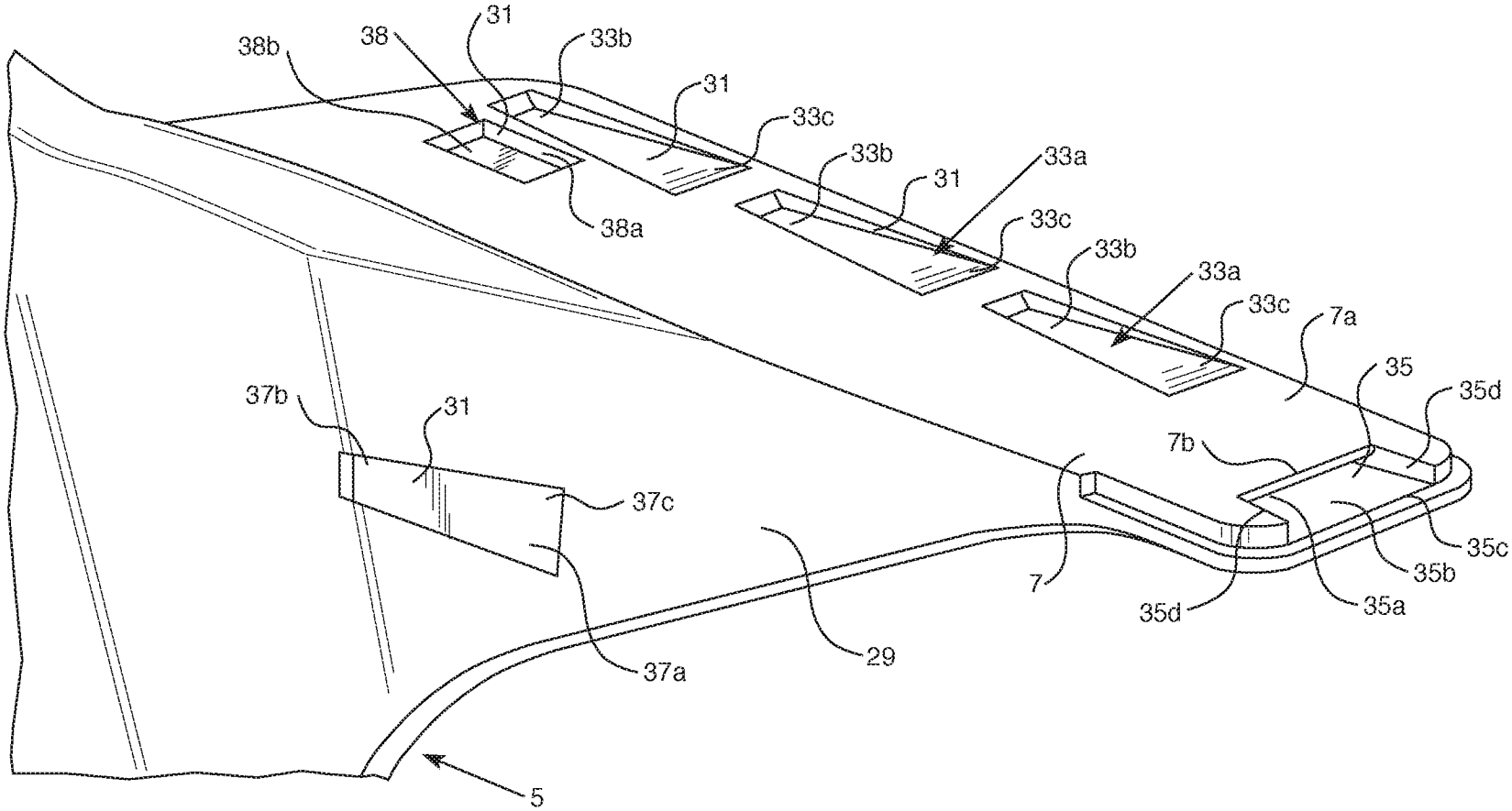
FIG. 7 is a perspective view of a second exemplary embodiment of the armrest apparatus 1 with the arm pad removed.
Figure 8:
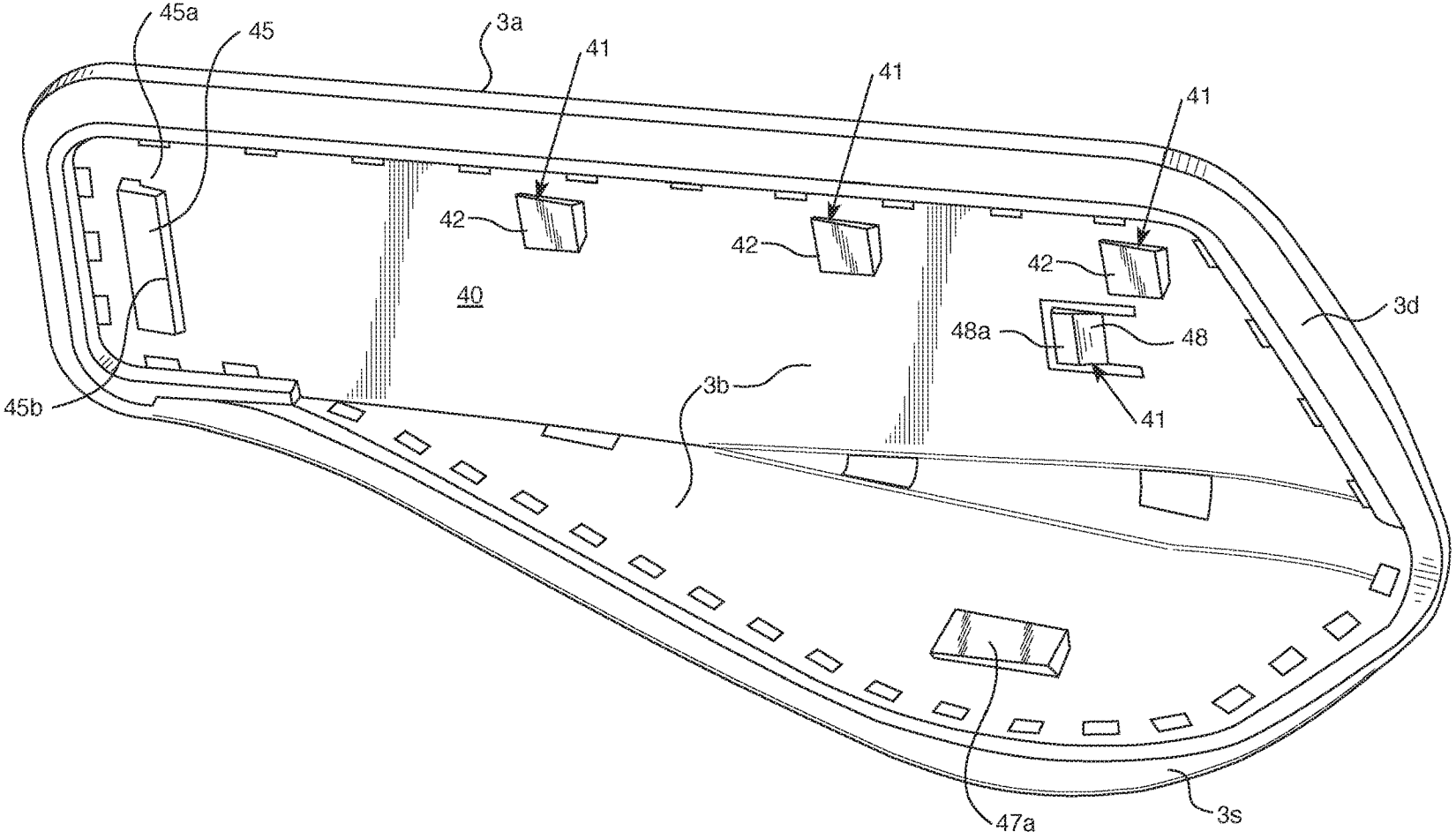
FIG. 8 is a perspective view of the arm pad of the second exemplary embodiment of the armrest apparatus 1.

As can be seen from FIGS. 7-8, other embodiments of the armrest apparatus can be configured so that the arm pad support plate 7 and/or armrest support member 5 can define locking feature apertures that are configured to matingly and interlockingly receive interlocking projection members extending from a bottom surface 3*b* of the arm pad 3 that are to face towards the upper and side surfaces of the arm pad support plate 7 and/or armrest support member 5.

For example, the arm pad support plate 7 can have a top surface 7*a* or other type of upper surface and/or a side surface that defines a number of locking feature apertures 31. The locking feature apertures can be arranged in spaced apart locations on the top surface 7*a* of the arm pad support plate 7. For example, there may be an arrangement of more than one (e.g. two, three, four, etc.) locking feature apertures defined in a spaced apart series of apertures to define an aligned column or row of apertures. Some embodiments may utilize only one such row or column while other embodiments utilize two or more spaced apart rows of locking feature apertures and two or more spaced apart columns of locking feature apertures. Some or all of the locking feature apertures 31 can be configured so they define ramped surfaces 33*a* (e.g. a linearly sloped surface that is inclined or declined defined by the arm pad support plate 7 at a bottom of the locking feature aperture 31). For instance, the ramped surface 33*a* that help define each locking feature aperture 31 can be defined to be linearly sloped so that a rear end 33*b* of the ramped surface 33*a* is deeper into the arm pad support plate 7*a* (e.g. is lower) than the front end 33*c* of the ramped surface 33*a*.

The armrest support member 5 can also define at least one locking feature aperture 37*a* that can be defined by an innermost surface that extends along a ramped or angled path such that the rear end 37*b* of the innermost surface is deeper into the armrest support member 5 than the front end 37*c* of the innermost surface that defines an innermost side of the aperture. In other embodiments, the arm pad support plate 7 can be structured so that the side of the arm pad support plate 7 has this side interlocking feature aperture instead of (or in addition to) a locking feature aperture being on a surface of the armrest support member 5.

The top surface 7*a* of the arm pad support plate 7 can also have other profiles defined therein to facilitate location and attachment of the arm pad 3 to the arm pad support plate 7 so that mechanical tools and/or fasteners are not needed for the attachment and no adhesive and no welding is needed for the direct attachment between the arm pad 3 and the arm pad support plate 7. For instance a locking feature aperture 31 can be polygonal in shape and have a depth within the arm pad support plate to define a recess 38 in the top surface 7*a* of the arm pad support plate 7 that has sidewalls 38*a* and a bottommost surface 38*b* defined by those sidewalls 38*a*. The arm pad support plate 7 can also have a front edge locking feature aperture that defines a front profile 35 that defines a lower front surface 35*b* below the top surface 7*a* and has a gap 35*a* defined between the lower front surface 35*b* and a central edge 7*b* of the top surface 7*a* that is located behind the front edge 35*c* of the lower front surface 35*b*. The gap 35*a* can define a pre-selected distance of space between the top of the lower front surface 35*b* and the bottom of the top surface 7*a* at the central front edge 7*b* of the top surface 7*a* of the arm pad support plate 7. The arm pad support plate 7 can have a body that is structured to define walls 35*d* that are spaced apart by the lower front surface 35*b* and are separated by a distance that is about as long as the front edge of the central edge 7*b* of the top surface 7*a* that is behind (e.g. more rearward than) the front edge 35*c* of the lower front surface 35*b*.

The arm pad 3 can have an outer top surface 3*a* and an outer side surface 3*s* that extends from the outer top surface 3*a* to below the outer top surface for positioning over a part of a side of the arm pad support plate 7 and/or side of the armrest support member 5. The bottom inner surfaces of the arm pad 3 can include a bottom surface 3*b* that has a first portion that is opposite the top outer surface 3*a* and faces toward the top of the arm pad support plate 7 and a second portion of the bottom surface 3*b* that is opposite that outer side surface 3*s* so that a portion of the bottom surface 3*b* is a lower side bottom surface that faces toward the arm pad attachment side surface 29 of the arm pad support plate 7 or armrest support member 5 when the arm pad is positioned for attachment to the arm pad support plate 7.

The arm pad 3 can also include a wall 3*d* that extends along a peripheral edge of the arm pad 3 (or adjacent a peripheral edge of the arm pad 3 and spaced inwardly from such a peripheral edge) between the outer and inner surfaces to define an opening 40 in which projecting locking members 41 are positioned. It should be appreciated that the opening 40 is a type of inner aperture 3*e*.

The locking members 41 can include a number of ramp contacting members 42 that are configured to contact the ramped surfaces 33*a* and a resilient locking finger 48 that has a distal edge 48*a* that is configured to be received within the recess 38. The distal edge 48*a* of the locking finger 48 can be configured to contact the lower surface 38*b* of the arm pad support plate 7 that defines the bottom of the recess 38 and resiliently engage at least one sidewall 38*a* that extend form the lower surface 38*b* to define the recess 38.

The front end (or front side) of the arm pad 3 can also include a front locking member 45 that is positioned to project outwardly from the bottom surface 3*b* and extend rearwardly along the bottom surface 3*b* in the opening 40 so that the rear edge portion 45*b* of the front locking member 45 is spaced apart from the bottom surface 3*b* by a gap 45*a*. The gap 45*a* can be sized to correspond with the thickness of the central front edge 7*b* of the top surface 7*a* so that the rear edge portion 45*b* of the front locking member 45 is receivable within the gap 35*a* and that an interference connection between the front locking member 45 and the front profile 35 can be formed when the arm pad is positioned for fastenerless attachment to the arm pad support plate 7. The front locking member 45 can be structured to function as a locating member that helps a user locate the proper position for the arm pad 3 on the arm pad support plate 7 as the arm pad is moved along the arm pad support plate 7 (e.g. via sliding the arm pad in a rearward direction along the arm pad support plate 7 until the front locking member 45 mates with profile 35, etc.) to attach the arm pad 3 to the arm pad support plate 7 without the use of any mechanical tool and without the use of any fasteners (e.g. bolts, screws, etc.) and without the use of welding and/or adhesives.

The arm pad 3 can be connected to the arm pad support plate 7 by sliding the arm pad 3 on to the arm pad support plate 7 so that the locking members contact bottom surfaces of structure defining the bottom of respective locking feature apertures during the sliding of the arm pad. For example, the arm pad can be slid so that the inner surfaces (e.g. bottom surface 3*b*) are slid along the arm pad support plate 7 and/or armrest support member 5 so that the ramp contacting members 42 contact with the ramped surfaces 33*a* in respective apertures, the distal edge 48*a* of the resilient locking finger 48 is resiliently moved toward the bottom surface 3*b* of the arm pad 3 until it is positioned over the recess 38. Once the finger 48 is moved over the recess 38, the distal edge 48*a* of the resilient finger 48 extends into the recess 38 for contacting at least one sidewall 38*a* for locating and locking the arm pad 3 onto the arm pad support plate 7. The front locking member 45 can be positioned on the bottom surface of the arm pad 3 so that when the resilient locking finger 48 is extended into the recess 38, the front locking member 45 is within the gap 35*a* of the front profile 35 for locating and locking of the position of the arm pad 3. The resilient locking finger 48 can help function to prevent the arm pad 3 from being slid off the arm pad support plate 7 and the shape and angle of the ramp contacting members 42 can be configured to help provide additional frictional force in the engagement of the arm pad 3 to the arm pad support plate 7 to prevent the arm pad 3 from being inadvertently slipped off the arm pad support plate 7. The front locking member 45 can provide additional friction to combat accidental dislodgement or disconnection of the arm pad 3 from the arm pad support plate 7 via the interference fit it may have with the arm pad support plate 7 provided by the front gap 35*a* and the rear edge portion 45*b* of the front locking member 45 contacting structure of the arm pad support plate defining the gap 35*a*. The front locking member 45 and front profile 35 can also be structured to help a user locate the correct position for arm pad placement for sliding the arm pad 3 or otherwise moving the arm pad 3 along the arm pad support plate 7 for a fastenerless connection of the arm pad 3 to the arm pad support plate 7 that directly attaches the arm pad 3 to the arm pad support plate 7.

In some embodiments, the arm pad 3 can also have at least one side inner surface locking member 47*a* that is configured to be positioned in a at least one locking feature aperture 37*a* of an arm pad attachment surface 29 of an armrest support member 5 or a side of an arm pad support plate 7 that is below the top surface 7*a* when the arm pad 3 is positioned for direct attachment with the arm pad support plate 7. Each side inner surface locking member 47*a* may be a ramp contacting member or structured as another type of projecting member or protuberance for mating in a corresponding recess, hole, opening, or other type of aperture for facilitating interlocking of the arm pad 3 and the arm pad support plate 7 and/or armrest support member 5.

It should be appreciated that, in some embodiments, the outer surfaces of the arm pad 3 may have a covering or be structured from a softer material, an elastomeric type material, or a resilient material to provide a pad for an arm of a seated user. In some embodiments, it is contemplated that the outer surface of the arm pad can have a pad that is covered by a covering or a resilient arm pad skin covering attached to the bottom 3*b* of the arm pad 3.

It should be appreciated that embodiments of the chair and armrest apparatus may utilize many different feature arrangements to meet different sets of design criteria. For example, it is contemplated that a particular feature described, either individually or as part of an embodiment, can be combined with other individually described features, or parts of other embodiments. The elements and acts of the various embodiments described herein can therefore be combined to provide further embodiments. It should therefore be appreciated that some components, features, and/or configurations that may be described in connection with only one particular embodiment can be applied or used with many other embodiments and should be considered applicable to the other embodiments, unless stated otherwise or unless such a component, feature, and/or configuration is technically impossible to use with the other embodiment. Thus, the components, features, and/or configurations of the various embodiments that can be appreciated from the disclosure provided herein can be combined together in any manner and such combinations are expressly contemplated and disclosed by this statement.

As another example, the seat of a chair to which an armrest apparatus 1 is attached may be a unitary structure composed of polymeric material or may be a structure that has many interconnected components, such as a foam member that is positioned between a fabric or leather covering and a rigid plate component or other intermediate structural component positioned above the feet or castors of the chair and below the seat of the chair. For instance, the seat may include a covering that may be a fabric or mesh material that is sewn, adhered or otherwise attached to a relatively rigid polymeric plate or metal plate to enclose a foam member, such as a foam cushion. As yet another example, it should be appreciated that the shape and configuration of the base of the chair to which the armrest apparatus 1 is attachable may be any of a number of different configurations needed to meet a particular design objective that permit the base to support the seat, chair back, and a user sitting on the seat and leaning on the chair back. As yet another example, each of the armrests for a chair can be configured to be affixed in a stationary manner or may be configured to be moveably attached to permit rotational and/or height adjustment of the position of the arm pad 3. The armrests can be attached to the backrest frame, the backrest, the seat frame of the seat, the seat, or the base, and/or a housing or other element positioned under the seat frame that is supported by legs or a pedestal base. As yet another example, the composition of the structures of the chair (e.g. backrest, armrest, and seat frame, etc.) can be any of a number of different suitable materials. For example, all of these components may be composed of a polymeric material, or some may be composed of a polymeric material while others are composed of metal, elastomeric material, or other type of material. Therefore it should be understood that while certain exemplary embodiments of a chair, armrest apparatuses for a chair, and methods of making and using the same have been discussed and illustrated herein, it is to be distinctly understood that the invention is not limited thereto but may be otherwise variously embodied and practiced within the scope of the following claims.

What is claimed is:

1. An armrest apparatus for a chair comprising:

an arm pad having a bottom, a wall projecting from a surface of the bottom to define an inner aperture, the wall defining spaced apart recesses that each have an opening mouth that face into the inner aperture and are in communication with the inner aperture; and an arm pad support plate that is configured for attachment to an armrest support member, the arm pad support plate having a wall that at least partially defines an inner cavity, the wall having a plurality of projections extending horizontally away from the wall, the projections being resilient, each of the projections sized and shaped to be matingly and interlockingly received within a respective one of the recesses of the wall of the arm pad for fastenerless connection of the arm pad to the arm pad support plate;

wherein the arm pad support plate has a plurality of columns, the columns positioned in the inner cavity.

2. The armrest apparatus of claim 1, wherein a top of each of the columns is positioned above a top of the wall of the arm pad support plate.

3. The armrest apparatus of claim 1, wherein the arm pad has a plurality of projections extending from the bottom of the arm pad, each of the projections configured to extend into a hole of a respective column.

4. The armrest apparatus of claim 3, wherein each of the projections that extend from the bottom of the arm pad is configured to resiliently deform for insertion into the hole of the column to which the projection is insertable so that resiliency of the projection causes the projection to help provide an interference fit connection between the projection and the column having the hole in which the projection is inserted.

5. The armrest apparatus of claim 4, wherein each of the projections extending horizontally away from the wall of the arm pad support plate is configured to resiliently deform for insertion into the opening mouth of the recess of the wall of the arm pad to which the projection is inserted so that resiliency of the projection causes the projection to help provide an interference fit connection between the projection and the wall of the arm pad having the recess in which the projection is inserted.

6. The armrest apparatus of claim 1, wherein each of the projections extending horizontally away from the wall of the arm pad support plate is configured to resiliently deform for insertion into the opening mouth of the recess of the wall of the arm pad to which the projection is inserted so that resiliency of the projection causes the projection to help provide an interference fit connection between the projection and the wall of the arm pad having the recess in which the projection is inserted.

7. An armrest apparatus for a chair comprising:

an arm pad having a bottom, a wall projecting from a surface of the bottom to define an inner aperture, and a plurality of locking members extending from the surface of the bottom positioned at least partially in the inner aperture; and an arm pad support plate that is configured for attachment to an armrest support member, the arm pad support plate having a plurality of locking feature apertures, each locking feature aperture configured to receive a respective one of the locking members to directly attach the arm pad to the arm pad support plate for fastenerless connection of the arm pad to the arm pad support plate;

wherein the plurality of locking feature apertures include apertures that are structured to define ramped surfaces of the arm pad support plate, the ramped surfaces being linearly sloped, rear ends of the ramped surfaces being positioned deeper into the arm pad support plate than front ends of the ramped surfaces.

8. The armrest apparatus of claim 7, wherein the plurality of locking members include a plurality of ramp contacting members, each of the ramp contacting members configured to contact a respective one of the ramped surfaces of the arm pad support plate to engage the ramped surface within the locking feature aperture that is structured to define the ramped surface that is engaged by the ramp contacting member.

9. An armrest apparatus for a chair comprising:

an arm pad having a bottom, a wall projecting from a surface of the bottom to define an inner aperture, and a plurality of locking members extending from the surface of the bottom positioned at least partially in the inner aperture; and an arm pad support plate that is configured for attachment to an armrest support member, the arm pad support plate having a plurality of locking feature apertures, each locking feature aperture configured to receive a respective one of the locking members to directly attach the arm pad to the arm pad support plate for fastenerless connection of the arm pad to the arm pad support plate;

wherein:

the arm pad includes a front locking member that extends from the bottom of the arm pad that is positioned at least partially within the inner aperture of the arm pad, the front locking member extending from the bottom of the arm pad such that a rear edge portion of the front locking member is spaced part from the bottom of the arm pad by a gap; and the plurality of locking feature apertures include a front edge locking feature aperture that defines a front profile of the arm pad support plate that is sized and configured to receive the front locking member that extends from the bottom of the arm pad, the front profile defining a lower front surface below the top surface and a gap defined between the lower front surface of the arm pad support plate and the top surface of the arm pad support plate, the rear edge portion of the front locking member being received with the gap defined between the lower front surface of the arm pad support plate and the top surface of the arm pad support plate.

10. An armrest apparatus for a chair comprising:

an arm pad having a bottom, a wall projecting from a surface of the bottom to define an inner aperture, and a plurality of locking members extending from the surface of the bottom positioned at least partially in the inner aperture; and an arm pad support plate that is configured for attachment to an armrest support member, the arm pad support plate having a plurality of locking feature apertures, each locking feature aperture configured to receive a respective one of the locking members to directly attach the arm pad to the arm pad support plate for fastenerless connection of the arm pad to the arm pad support plate;

wherein the plurality of locking feature apertures include a recess within the top surface of the arm pad support plate.

11. The armrest apparatus of claim 10, wherein the plurality of locking members include a resilient locking finger that extends from the bottom of the arm pad, the resilient locking finger having a distal edge that is configured to be received within thee recess and resiliently engage at least one sidewall that defines the recess.

12. The armrest apparatus of claim 11, wherein:

the arm pad includes a front locking member that extends from the bottom of the arm pad that is positioned at least partially within the inner aperture of the arm pad, the front locking member extending from a bottom surface of the bottom of the arm pad such that a rear edge portion of the front locking member is spaced part from the bottom of the arm pad by a gap; and the plurality of locking feature apertures include a front edge locking feature aperture that defines a front profile of the arm pad support plate that is sized and configured to receive the front locking member that extends from the bottom of the arm pad, the front profile defining a lower front surface below the top surface and a gap defined between the lower front surface of the arm pad support plate and the top surface of the arm pad support plate, the rear edge portion of the front locking member being received with the gap defined between the lower front surface of the arm pad support plate and the top surface of the arm pad support plate.

13. The armrest apparatus of claim 12, wherein:

the plurality of locking feature apertures include apertures that are structured to define ramped surfaces of the arm pad support plate, the ramped surfaces being linearly sloped, rear ends of the ramped surfaces being positioned deeper into the arm pad support plate than front ends of the ramped surfaces; and the plurality of locking members include a plurality of ramp contacting members, each of the ramp contacting members configured to contact a respective one of the ramped surfaces of the arm pad support plate to engage the ramped surface within the locking feature aperture that is structured to define the ramped surface that is engaged by the ramp contacting member.

14. The armrest apparatus of claim 11, wherein:

the plurality of locking feature apertures include apertures that are structured to define ramped surfaces of the arm pad support plate, the ramped surfaces being linearly sloped, rear ends of the ramped surfaces being positioned deeper into the arm pad support plate than front ends of the ramped surfaces; and the plurality of locking members include a plurality of ramp contacting members, each of the ramp contacting members configured to contact a respective one of the ramped surfaces of the arm pad support plate to engage the ramped surface within the locking feature aperture that is structured to define the ramped surface that is engaged by the ramp contacting member.

15. A method of attaching an arm pad to an arm pad support plate for fastenerless connection of the arm pad to the arm pad support plate, the method comprising:

providing an arm pad support plate, the arm pad support plate having:

a wall that at least partially defines an inner cavity, the wall having a plurality of projections extending horizontally away from the wall, the projections being resilient, and/or a plurality of locking feature apertures for fastenerless connection of the arm pad to the arm pad support plate;

providing an arm pad, the arm pad having a bottom, a wall projecting from a surface of the bottom to define an inner aperture, the wall of the arm pad defining spaced apart recesses that each have an opening mouth that face into the inner aperture and are in communication with the inner aperture, each of the recesses sized and configured to receive a respective one of the projections of the wall of the arm pad support plate, and/or a plurality of locking members extending from the surface of the bottom of the arm pad positioned at least partially in the inner aperture; and positioning the arm pad along the arm pad support plate for directly attaching the arm pad to the arm pad support plate for fastenerless connection of the arm pad to the arm pad support plate;

wherein:

the arm pad support plate has the plurality of locking feature apertures, the plurality of locking feature apertures including:

apertures that are structured to define ramped surfaces of the arm pad support plate, the ramped surfaces being linearly sloped, rear ends of the ramped surfaces being positioned deeper into the arm pad support plate than front ends of the ramped surfaces, a front edge locking feature aperture that defines a front profile of the arm pad support plate that is sized and configured to receive a front locking member that extends from the bottom of the arm pad, the front profile defining a lower front surface below the top surface and a gap defined between the lower front surface of the arm pad support plate and the top surface of the arm pad support plate, a rear edge portion of the front locking member being receivable within the gap defined between the lower front surface of the arm pad support plate and the top surface of the arm pad support plate; and a recess within the top surface of the arm pad support plate; and the arm pad has the plurality of locking members, the locking members including:

a plurality of ramp contacting members, each of the ramp contacting members configured to contact a respective one of the ramped surfaces of the arm pad support plate to engage the ramped surface within the locking feature aperture that is structured to define the ramped surface that is engaged by the ramp contacting member;

the front locking member that extends from the bottom of the arm pad that is positioned at least partially within the inner aperture of the arm pad, the front locking member extending from the bottom of the arm pad such that the rear edge portion of the front locking member is spaced part from the bottom of the arm pad by a gap; and a resilient locking finger that extends from the bottom of the arm pad, the resilient locking finger having a distal edge that is configured to be received within the recess and resiliently engage at least one sidewall that defines the recess.

16. The method of claim 15, wherein the positioning of the arm pad along the arm pad support member comprises sliding the arm pad along the arm pad support member.

17. A method of attaching an arm pad to an arm pad support plate for fastenerless connection of the arm pad to the arm pad support plate, the method comprising:

providing an arm pad support plate, the arm pad support plate having:

a wall that at least partially defines an inner cavity, the wall having a plurality of projections extending horizontally away from the wall, the projections being resilient, and/or a plurality of locking feature apertures for fastenerless connection of the arm pad to the arm pad support plate;

providing an arm pad, the arm pad having a bottom, a wall projecting from a surface of the bottom to define an inner aperture, the wall of the arm pad defining spaced apart recesses that each have an opening mouth that face into the inner aperture and are in communication with the inner aperture, each of the recesses sized and configured to receive a respective one of the projections of the wall of the arm pad support plate, and/or a plurality of locking members extending from the surface of the bottom of the arm pad positioned at least partially in the inner aperture; and positioning the arm pad along the arm pad support plate for directly attaching the arm pad to the arm pad support plate for fastenerless connection of the arm pad to the arm pad support plate;

wherein:

the arm pad support plate has a plurality of columns, the columns positioned in the inner cavity, a top of each of the columns being positioned above a top of the wall of the arm pad support plate;

wherein each of the projections extending horizontally away from the wall of the arm pad support plate is configured to resiliently deform for insertion into the opening mouth of the recess of the wall of the arm pad to which the projection is inserted so that resiliency of the projection causes the projection to help provide an interference fit connection between the projection and the wall of the arm pad having the recess in which the projection is inserted; and the arm pad has a plurality of projections extending from the bottom of the arm pad, each of the projections extending from the bottom of the arm pad configured to extend into a hole of a respective column of the plurality of columns, each of the projections that extend from the bottom of the arm pad being configured to resiliently deform for insertion into the hole of the column to which the projection is insertable so that resiliency of the projection causes the projection to help provide an interference fit connection between the projection and the column having the hole in which the projection is inserted.

* * * * *